US011205373B2

(12) United States Patent
Lee

(10) Patent No.: US 11,205,373 B2
(45) Date of Patent: Dec. 21, 2021

(54) DISPLAY APPARATUS TO MITIGATE DIMMING PHENOMENON AND CONTROL METHOD THEREOF

(71) Applicant: SAMSUNG ELECTRONICS CO., LTD., Suwon-si (KR)

(72) Inventor: Jaehyang Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/855,127

(22) Filed: Apr. 22, 2020

(65) Prior Publication Data

US 2020/0335034 A1 Oct. 22, 2020

(30) Foreign Application Priority Data

Apr. 22, 2019 (KR) ..... 10-2019-0046774

(51) Int. Cl.
*G09G 3/32* (2016.01)

(52) U.S. Cl.
CPC ..... *G09G 3/32* (2013.01); *G09G 2300/06* (2013.01); *G09G 2310/0267* (2013.01); *G09G 2320/0233* (2013.01)

(58) Field of Classification Search
CPC ..... G09G 2320/0233; G09G 2310/08
See application file for complete search history.

(56) References Cited

U.S. PATENT DOCUMENTS 8,031,153 B2 10/2011 Kang et al.
8,947,413 B2 * 2/2015 Hotelling ..... G09G 3/3614 345/209
9,084,319 B2 7/2015 Sullivan et al.
9,165,506 B2 10/2015 Gu et al.
10,324,561 B2 6/2019 Cho et al.
10,522,075 B2 12/2019 Pyo et al.
10,741,118 B2 8/2020 Park et al.
10,878,749 B2 * 12/2020 Lee ..... G09G 3/3275
2005/0225545 A1 * 10/2005 Takatori ..... G09G 3/3611 345/204
2008/0129904 A1 6/2008 Kang et al.
(Continued)

FOREIGN PATENT DOCUMENTS

JP 2011-232535 A 11/2011
KR 10-1386365 B1 4/2014
(Continued)

OTHER PUBLICATIONS

Communication dated Aug. 20, 2020, issued by the International Searching Authority in counterpart International Application No. PCT/KR2020/005193 (PCT/ISA/210 and PCT/ISA/237).

*Primary Examiner* — Laurence J Lee
(74) *Attorney, Agent, or Firm* — Sughrue Mion, PLLC

(57) ABSTRACT

A display apparatus and a method of controlling thereof are provided. The display apparatus may include a display including a plurality of light emitting diode (LED) devices, a driver configured to drive the plurality of LED devices, and a controller configured to control the driver to apply an image signal to each of a plurality of scan lines, and apply a first image signal to a first image frame period in a first scan line among the plurality of scan lines and apply the first image signal to a second image frame period in a second scan line among the plurality of scan lines.

17 Claims, 8 Drawing Sheets

(56) References Cited

U.S. PATENT DOCUMENTS

| | | | | |
|---|---|---|---|---|
| 2008/0224984 | A1* | 9/2008 | Chang | G09G 3/3648 345/100 |
| 2013/0120477 | A1* | 5/2013 | Matsumoto | G09G 5/10 345/690 |
| 2014/0176616 | A1 | 6/2014 | Gu et al. | |
| 2015/0269888 | A1 | 9/2015 | Kim | |
| 2016/0078802 | A1 | 3/2016 | Liang et al. | |
| 2018/0130404 | A1 | 5/2018 | Park et al. | |

FOREIGN PATENT DOCUMENTS

| | | | |
|---|---|---|---|
| KR | 10-2014-0083399 | A | 7/2014 |
| KR | 10-2017-0005941 | A | 1/2017 |
| KR | 10-2017-0049002 | A | 5/2017 |
| KR | 10-1777133 | B1 | 9/2017 |
| KR | 10-2018-0050125 | A | 5/2018 |

* cited by examiner

DISPLAY APPARATUS TO MITIGATE DIMMING PHENOMENON AND CONTROL METHOD THEREOF

CROSS-REFERENCE TO RELATED APPLICATION(S)

This application is based on and claims priority under 35 U.S.C. § 119 to Korean Patent Application No. 10-2019-0046774, filed on Apr. 22, 2019, in the Korean Intellectual Property Office, the disclosure of which is incorporated by reference herein in its entirety.

BACKGROUND

1. Field

The disclosure is directed to a display apparatus and a control method thereof, and more specifically, to a display apparatus scanning image signals on a scan line basis and a control method thereof.

2. Description of Related Art

Recently, light emitting diode (LED) display apparatuses have been implementing a scan driving method for each scan line to be driven sequentially. Generally, LED display apparatuses apply image signals from a scan line corresponding to a LED line physically arranged at the uppermost end in the display apparatus for each image frame using the top-to-bottom method as illustrated in FIG. 1.

However, since the time required until a scan line that first emits light in each image frame may be relatively delayed compared to other scan lines, a dim phenomenon that darkens the first light emitting scan line may occur.

Conventionally, since the line that first emits light per each image frame corresponds to the LED line arranged at the uppermost end in the display apparatus, there is a disadvantage of the upper end part of the display screen appearing dark due to the dim phenomenon accumulating on the corresponding scan line.

SUMMARY

Embodiments of the disclosure provide a display apparatus that reduces a dim phenomenon by having different scan lines in each image frame to first emit light and a control method thereof.

According to an embodiment, there is provided a display apparatus including a display comprising a plurality of light emitting diode (LED) devices; a driver configured to drive the plurality of LED devices; and a controller configured to control the driver to apply an image signal to each of a plurality of scan lines, and apply a first image signal to a first image frame period in a first scan line among the plurality of scan lines and apply the first image signal to a second image frame period in a second scan line among the plurality of scan lines.

The controller is further configured to control the driver to apply for a first time the first image signal to the first scan line in a first sub-period of the first image frame period and apply for a first time the first image signal to the first scan line in a second sub-period of the first image frame period, and control the driver to apply for a first time the first image signal to the second scan line in a first sub-period of the second image frame period and apply for a first time the first image signal to the second scan line in a second sub-period of the second image frame period.

The controller is further configured to apply a final image signal among a plurality of image signals to each sub-period of the second image frame period in the first scan line.

The second scan line is a scan line immediately below the first scan line.

The second scan line is a scan line after a predetermined line interval from the first scan line.

The first scan line includes a plurality of sections, and a first section among the plurality of section is included in the first image frame period and a second section among the plurality of sections is included in the second image frame period.

The second image frame period is a frame period after a predetermined frame period interval from the first image frame period.

The controller is further configured to adjust the predetermined frame interval based on a brightness information of the first image frame.

The controller is further configured to, based on a third image signal being finally applied to a last one of a plurality of frame periods in a third scan line, apply a fourth image signal to the second image frame period of the second scan line adjacent to the third scan line.

The plurality of LED devices is a micro LED device.

According to another embodiment, there is provided a control method of a display apparatus applying an image signal to a plurality of scan lines, by a driver driving a plurality of light emitting diode (LED) devices in a passive matrix (PM) method. The method including applying a first image signal to a first image frame period in a first scan line; and applying a second image signal to a second image frame period in a second scan line.

The applying for a first time the first image signal to the first scan line further includes applying for a first time the first image signal to a first sub-period of the first image frame period in the first scan line and applying for a first time the first image signal to a second sub-period of the first image frame period in the first scan line, and the applying for a first time the second image signal to the second scan line further includes applying for a first time the second image signal to a first sub-period of the second image frame period in the second scan line and applying for a first time the second image signal to a second sub-period of the second image frame period in the second scan line.

The method further includes applying a final image signal among a plurality of image signals to each sub-period of the second image frame period in the first scan line.

The second scan line is a scan line immediately below the first scan line.

The second scan line is a scan line after a predetermined line interval from the first scan line.

The first scan line includes a plurality of sections, and a first section among the plurality of sections in the first scan line is included in the first image frame period and a second section among the plurality of sections is included in the second image frame period.

The second image frame period is a frame period after a predetermined frame period interval from the first image frame period.

The method further includes adjusting the predetermined frame interval based on a brightness information of the first image frame.

The method further includes, based on a third image signal being finally applied to a last one of a plurality of frame periods in a third scan line, applying a fourth image signal to the second image frame period of the second scan line adjacent to the third scan line.

The plurality of LED devices is a micro LED device.

BRIEF DESCRIPTION OF THE DRAWINGS

The above and other aspects, features and advantages of embodiments of the present disclosure will be more apparent from the following detailed description, taken in conjunction with the accompanying drawings, in which.

DETAILED DESCRIPTION

Figure 1:
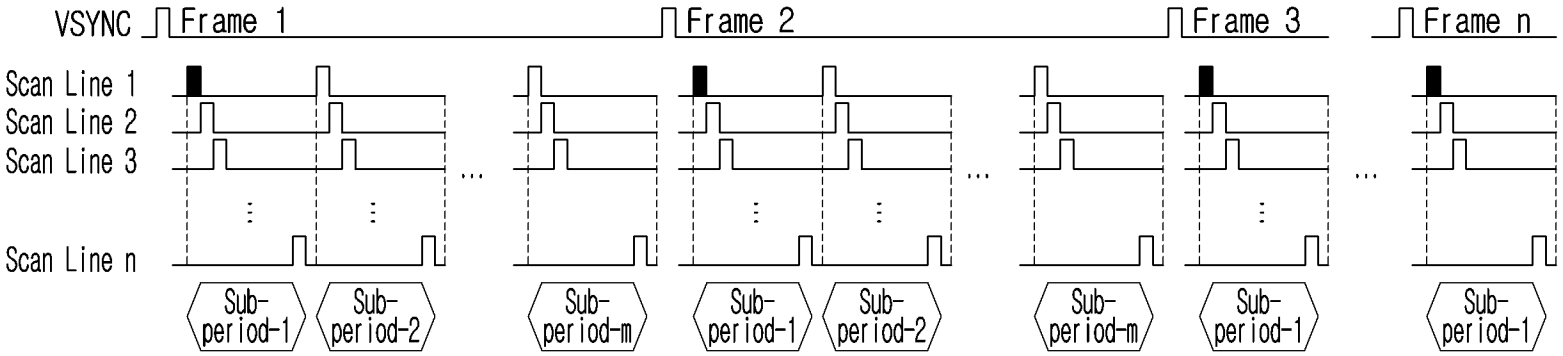
FIG. 1 is a diagram illustrating a conventional scheme of displaying an image.

The disclosure will be explained in detail below with reference to the accompanying drawings.

The terms used in the disclosure will be briefly described.

The terms used in herein have been selected from general terms currently and widely used in consideration of the functions in the various embodiments of the disclosure, but may be changed according to the intention of those skilled in the related art, judicial precedence, emergence of new technologies, and the like. The disclosure may use arbitrarily selected terms, and the meanings thereof will be described in detail in the disclosure. Accordingly, terms used in the disclosure are not to be simply understood by the names, but may be understood based on the meaning of the term and the context throughout the disclosure.

Various modifications may be made to the embodiments of the disclosure, and there may be various types of embodiments. Accordingly, specific embodiments will be illustrated in the accompanying drawings, and the embodiments will be described in detail in the detailed description. However, it should be noted that the various embodiments are not intended to limit the scope of the disclosure to a specific embodiment, but should be interpreted to include all modifications, equivalents or alternatives of the embodiments included in the ideas and the technical scope of the disclosure as set forth herein. In case it is determined that the detailed description of known technologies may unnecessarily confuse the gist of the disclosure in describing embodiments, the detailed description may be omitted.

A singular expression may include a plural expression, unless indicated otherwise. It is to be understood that the terms such as "comprise" or "consist of" are used herein to designate a presence of a characteristic, number, step, operation, element, component, or a combination thereof, and not to preclude a presence or a possibility of adding one or more of other characteristics, numbers, steps, operations, elements, components or a combination thereof.

The expression "at least one of A and/or B" may be understood as at least one "A" or at least one "B", "A" or "B", at least one "A" and at least one "B", and "A" and "B".

The terms such as "first" or "second" used in the disclosure may be used to identify various elements regardless of order and/or importance, and may be used to differentiate one element from another but the relevant elements should not be limited thereto.

When an element (e.g., first element) being indicated as being "coupled (operatively or communicatively) to" or "connected to" another element (e.g., second element), it is to be understood that a certain element may be directly coupled to another element or may be coupled through another element (e.g., third element).

The "module" or "unit" referred herein may perform at least one function or operation, and may be implemented as a hardware or a software, or a combination of hardware and software. Further, except for when a plurality of "modules" or "units" need to be implemented in a particular hardware, the components may be integrated in at least one module and implemented as at least one processor. In the disclosure, the term "user" may refer to a person using an electronic apparatus (or, display apparatus) or an apparatus (e.g., electronic apparatus with artificial intelligence) using an electronic apparatus.

Embodiments of the disclosure will be described in detail below with reference to the accompanying drawings to aid in the understanding of those of ordinary skill in the art. However, the disclosure may be implemented in various different forms and is not limited to the embodiments described herein. Further, in the drawings, parts not relevant to the description may be omitted, and like reference numerals may be used to indicate like elements.

Figure 2:
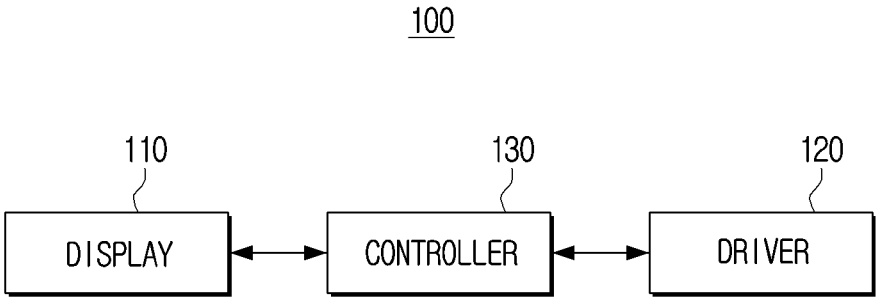
FIG. 2 is a block diagram illustrating a display apparatus according to an embodiment.

FIG. 2 is a block diagram illustrating a display apparatus according to an embodiment.

As illustrated in FIG. 2, the display apparatus according to an embodiment may include a plurality of self-luminescent devices. The self-luminescent devices may be at least one of a light emitting diode (LED) or a micro LED.

According to an embodiment, the display apparatus 100 may be implemented as a single-panel (for example, a small format display such as a smartphone and a home TV), but in another embodiment, the display apparatus may be implemented in the form of a plurality of display modules being physically coupled (for example, a large format display such as an outdoor signage and electronic display boards).

For example, the display module may be implemented as a LED module with each of a plurality of pixels being implemented as a light emitting diode (LED) pixel, or as a LED cabinet coupled with a plurality of LED modules, but is not limited thereto. The display apparatus 100 may be implemented as a display using a liquid crystal display (LCD), an organic light-emitting diode (OLED), a passive-matrix OLED (PMOLED), a plasma display panel (PDP), a micro LED, a quantum dot (QD), and the like.

The display apparatus 100 may be driven according to a passive matrix (PM) driving method. The passive matrix (PM) driving method is a method of sequentially applying current or voltage to an electrode of a scan line in a horizontal direction and an electrode of a data line in a vertical direction. Based on the PM driving method, a signal may be transmitted sequentially to each scan line. For example, a signal may be transmitted to scan line 1, and a signal may then be transmitted to scan line 2, which is the following line. In addition, based on whether a signal is transmitted from the data line, an LED device for turning-on or turning-off may be determined. Based on a voltage difference between the horizontal direction electrode and the vertical direction electrode according to the PM driving method, the corresponding LED device may be turned-on. Conversely, the corresponding LED device may be turned-off if there is no voltage difference. Unlike the PM driving method, an active matrix (AM) driving method may include a thin film transistor (TFT) that acts as a switch and a storage capacitor. Accordingly, the AM driving method may be maintained for one frame without the previously turned-on LED device being turned-off even when the next scan line is selected.

The method driving the LED device according to various embodiments described below is based on the passive matrix (PM) driving method.

The display apparatus 100 may turn on red (R), green (G), blue (B) elements, which are sub pixels of the LED device arranged on each scan line by applying an image signal on a scan line basis. However, as illustrated in FIG. 1, if an image signal is applied to a scan line (e.g., scan line 1) corresponding to the LED line of the uppermost end for each image frame, a dim phenomenon at scan line 1 may be accumulated and the upper end part of the display screen may appear dark.

Accordingly, various embodiments for reducing accumulation of dim phenomenon by having different scan lines to first emit light in each image frame will be described herein.

Referring to FIG. 2, the display apparatus 100 may include a display 110, a driver 120, and a controller 130.

The display 110 may include a plurality of LED devices. As described above, the display 110 may be implemented as a single panel display or a modular display.

The LED device may be implemented as a RGB LED, and the RGB LED may include a red LED (R), a green LED (G), and a blue LED (B). Further, the LED device may further include a white LED in addition to the RGB LED.

According to an embodiment, the LED device may be implemented as a micro LED. The micro LED may be an LED of about 5 to 100 micrometer in size, and includes an ultra-small light emitting diode that emits light on its own without a color filter.

The driver 120 may drive the display 110. For example, the driver 120 may drive each LED pixel by applying driving voltage or driving current in order to drive each self-luminescent device (for example, an LED pixel) constituting the display 110 under the control of the controller 130. The driver 120 may drive the LED device by the PM method. The driver 120 may control the LED device by sequentially applying voltage or current to a plurality of electrodes of the scan lines in the horizontal direction and a plurality of electrodes of the data lines in the vertical direction.

According to an embodiment, based on the display 110 being implemented in a form including the plurality of LED modules, the driver 120 may include the LED driving module coupled to each of the plurality of LED modules, but is not limited thereto. The driver 120 may be implemented as a driving module that controls the plurality of LED modules. The LED driving module may display an image corresponding to an image data on the display screen by transmitting the image data received from the controller 130 to the plurality of scan lines coupled to each LED driving module.

The driver 120 may adjust and output a supply time or strength of the driving current supplied to the LED module to correspond to the image signal to be input.

Specifically, the LED driving module may sequentially scan the image signal received from the controller 130 on each scan line and may control the LED module to output the image data.

The display 110 may include the plurality of display modules. For example, based on four display modules being coupled and being configured as one screen, four images corresponding to each display module may be simultaneously output four images as one image to display 110. Here, the driving module that corresponds to each display module may simultaneously scan the image signal on the scan line by the control of the controller 130. For example, the timing of the image signal being scanned on a first scan line of a first display module and the first scan line of the second display module may be the same. Accordingly, the user may recognize the overall image with a plurality of partial images combined as one image.

The driver 120 may include a power supply unit to provide power supply. The power supply unit may be a hardware that provides power appropriately to each system by converting an alternating current (AC) to a direct current (DC) to be stably used in the display 110. The power supply unit may include an input electromagnetic interference (EMI) filterer, an alternating-direct rectifier, a direct-direct switching converter, an output filter and an outputter.

The power supply unit may be implemented as, for example, a switched mode power supply (SMPS). The SMPS may be capable of high efficiency, miniaturization, and weight-lightening as a direct stabilization power supply apparatus that stabilizes output by controlling an on-off time ratio of a semiconductor switch device, and may be used to drive the display 110.

The controller 130 may control the overall operation on signal processing of the display apparatus 100. According to an embodiment, the controller 130 may be implemented as a time controller (TCON) that transmits an image signal to the driver 120. In some cases, the controller may be arranged outside of the display apparatus 100.

The controller 130 may control the driver 120 for the display 110 to display an image frame by applying an image signal on a scan line basis. The scan line may be coupled to the driver 120 and may refer to a line on which an image signal is scanned as voltage or current is applied from the driver 120, and a plurality of scan lines may be coupled to a driver 120. A plurality of LED devices may be included in a scan line and each of the red (R), green (G) and blue (B) sub pixels of the LED device included in the corresponding scan line may be turned on or off according to the image signal.

Figure 4:
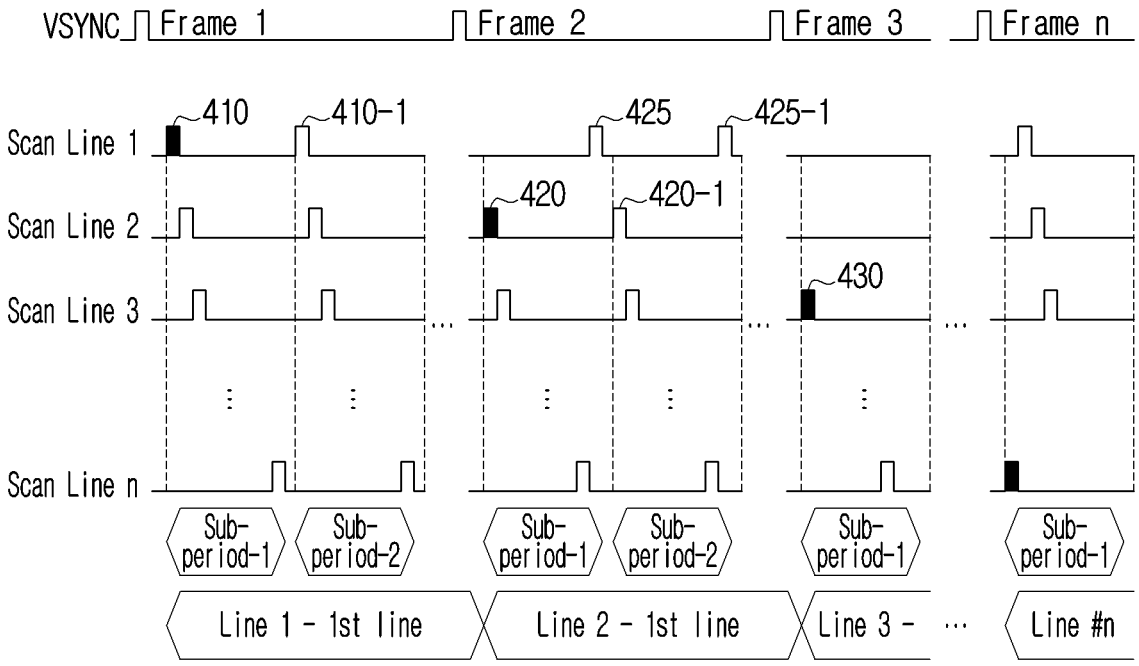
FIG. 4 is a diagram illustrating an example of a scan line applied with image signals for a first time in each image frame according to an embodiment.

Referring to FIG. 4, based on an n-number of scan lines being coupled to a driver 120, one or more image signals may be input from the first scan line to the n-th scan line sequentially. A period of the one or more image signals being input from the first scan line to the n-th scan line may be referred to as a sub-period, and a frame may be generated by repeating the sub-period multiple times. For example, based on the frequency of the image signal being 60 hz, a frame may be formed by repeating the sub-period 60 times. The sub-period may be referred to as a sub-cycle, a sub-frame, a sub-stage, and the like, but will be collectively referred to as sub-period herein for the convenience of description.

The controller 130 may control the driver 120 to apply, at a first time, the image signal to the first scan line in the first image frame period. That is, the controller 130 may apply the first image signal in the first image frame period to the first scan line among the plurality of scan lines coupled to the driver 120. The controller 130 may then apply a second image signal in the first image frame period to the next line (or section) of the first scan line, and may sequentially apply an n-number of image signals to the n-th scan line by repeating this operation.

The controller 130 may control the driver 120 to apply, at a first time, the image signal corresponding to the second scan line in the second image frame period. That is, the controller 130 may apply the first image signal in the second image frame period to the second scan line among the plurality of scan lines coupled to the driver 120. The controller 130 may then apply the second image signal in the second image frame period to the next line (or section) of the second scan line, and may sequentially apply an n-number of image signals to the n-th scan line by repeating this operation.

In other words, the controller 130 may control the driver 120 for the scan line applied with an image signal for a first time for each image frame to be different. The above will be described in greater detail in FIG. 4.

FIG. 4 is a diagram illustrating an example of a scan line applied with image signals for a first time in each image frame according to an embodiment.

Referring to FIG. 4, the controller 130 may apply, at a first time, an image signal 410 to scan line 1 (first scan line) in frame 1 (first image frame) period. The controller 130 may then apply, at the first time, an image signal 420 to scan line 2 (second scan line) in frame 2 (second image frame) period. Likewise, the controller 130 may apply, at the first time, an image signal 430 corresponding to scan line 3 in frame 3 period.

That is, the controller 130 may control the driver 120 to apply a plurality of different image signals to the plurality of scan lines for each image frame. Accordingly, the accumulation of dim phenomenon on a specific scan line may be reduced.

The controller 130 may apply for the first time the image signal corresponding the first scan line in the first sub-period of the first image frame period, and may apply for the first time the image signal corresponding to the first scan line in the second sub-period. Specifically, referring to FIG. 4, based on the image signal 410 corresponding to scan line 1 (first scan line) in the first sub-period (sub-period-1) of the first image frame period being applied for the first time, the controller 130 may apply for the first time the image signal 410-1 corresponding to scan line 1 in the second sub-period (sub-period-2).

In addition, the controller 130 may apply, for the first time, a second image signal to the second scan line in the first sub-period of the second image frame period, and may apply, for the first time, the image signal corresponding to the second scan line in the second sub-period. Specifically, referring to FIG. 4, based on the image signal 420 being input to scan line 2 (second scan line) in the first sub-period (sub-period-1) of the second image frame period, the controller 130 may apply for the first time the image signal 420-1 to scan line 2 in the second sub-period (sub-period-2).

That is, the image signal applied for the first time in each of the plurality of sub-periods included in an image frame may be the same.

The controller may apply for a final time the image signal to the first scan line of the second image frame period. Specifically, referring to FIG. 4, based on the image signal 420 to scan line 2 (second scan line) of the second image frame period being applied for the first time, the controller 130 may apply for the final time the image signal 425 corresponding to scan line 1 (first scan line). Based on the image signal being sequentially applied from scan line 2 of the second image frame period, the controller 130 may finally apply the image signal 425 to scan line 1 after the image signal is applied to scan line n.

In addition, the controller 130 may finally apply the image signal corresponding to the first scan line in each sub-period of the second image frame period. Specifically, based on the image signal 420-1 corresponding to scan line 2 (second scan line) in the second sub-period (sub-period-2) of the second image frame period being applied for the first time, the controller 130 may finally apply the image signal 425-1 corresponding to scan line 1 (first scan line) and may repeat the above-described operation even in remaining sub-periods of the second image frame period.

That is, the scan line with the image signal applied for the final time in each of the plurality of sub-periods included in an image frame may be the same.

Referring to FIG. 4, the second scan line may be the line immediately following the first scan line. That is, the controller 130 may sequentially adjust the scan line that applies the image signal for the first time for each image frame. For example, based on the first image signal being applied to scan line 1 in frame 1 period, the first image signal may be applied to scan line 2, which is the line immediately following scan line 1 in frame 2 period. In addition, the first image signal may be applied to scan line 3, which is the line immediately flowing scan line 2 in frame 3 period.

However, the above is not limited thereto, and the second scan line may be the line after a predetermined line interval based on the first scan line or may be an arbitrary line different from the first scan line of the plurality of scan lines included in the second image frame.

Referring to FIG. 4, the number of scan lines and the number of image frames may all be identically designated as "n-number", but this is merely an example, and may be realized in different numbers. In addition, the number of sub-periods may be determined based on a grayscale value of an image. For example, based on a higher grayscale value (e.g., Gray 255), the number of sub-periods may increase, and based on a lower grayscale value (e.g., Gray 10), the number of sub-periods may decrease. Further, based on the grayscale being a lower grayscale value, the power or current may not be provided to all scan lines in at least one of the plurality of sub-periods may be included.

Referring to FIG. 4, the second image frame may be the frame following a predetermined frame interval the first image frame. For example, the second image frame (frame 2) may be the frame immediately following the first image frame (frame 1).

The above embodiments will be described in greater detail in FIG. 5.

Figure 5:
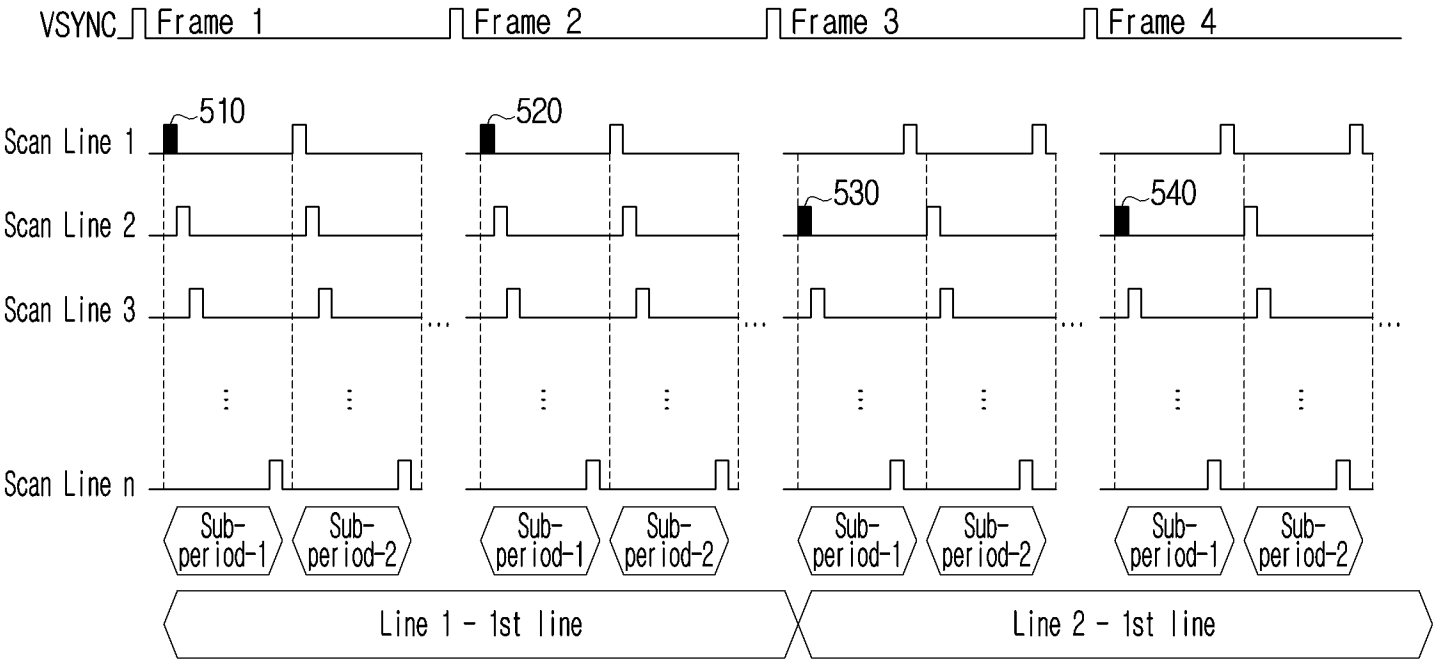
FIG. 5 is a diagram illustrating an example of a second image frame after a predetermined frame interval from displaying a first image frame according to an embodiment.

FIG. 5 is a diagram illustrating an example of a second image frame after a predetermined frame interval based on a first image frame according to an embodiment.

In FIG. 5, a predetermined frame interval may be one frame. Referring to FIG. 5, the controller 130 may apply for the first time an image signal 510 corresponding to scan line 1 (first scan line) in frame 1 (first image frame) period. In addition, the controller may apply for the first time an image signal 520 corresponding to scan line 1 (first scan line) in frame 2 (second image frame) period.

The controller 130 may then apply for the first time an image signal 530 to scan line 2 (second scan line) in frame 3 (third image frame) period. Further, the controller 130 may apply for the first time an image signal 540 to scan line 2 (second scan line) in frame 4 (fourth image frame) period.

That is, based on the predetermined frame interval being one frame, the image signal may be applied for the first time to scan line 1 in frame 1 and frame 2, and the image signal may be applied for the first time to scan line 2 in frame 3 and frame 4.

Referring back to FIG. 2, the controller 130 may, based on brightness information of the first image frame, adjust the predetermined frame interval. Generally, based on the displayed image frame being in a low grayscale state, a dim phenomenon of a part of the display screen appearing dark may be easily recognized by a user. Accordingly, the controller 130 may, based on brightness information of a past image frame, adjust the predetermined frame interval.

For example, the controller 130 may, based on the brightness value of the first image frame being less than a first threshold value, adjust the predetermined frame interval to 0 frame, and may change the scan line with the image signal being applied for the first time for each image frame. Accordingly, the user may not recognize the dim phenomenon even when the displayed image frame is in a low grayscale state.

In addition, the controller 130 may, based on a brightness value of the first image frame being a first threshold value or more and being less than a second threshold value, adjust the predetermined frame interval to one frame to change the scan line with the image signal being applied for the first time for every two image frames. In addition, the controller 130 may, based on the brightness value of the first image frame being a second threshold value or more, adjust the predetermined frame interval to two frames to change the scan line with the image signal applied for the first time for every three image frames. However, the number of threshold values, the threshold value periods and the number of predetermined frame intervals are merely an example, and may be applied with various modifications.

According to an embodiment, the second scan line may be a line after the predetermined line interval based on the first scan line. The above embodiment will be described in greater detail in FIG. 6.

Figure 6:
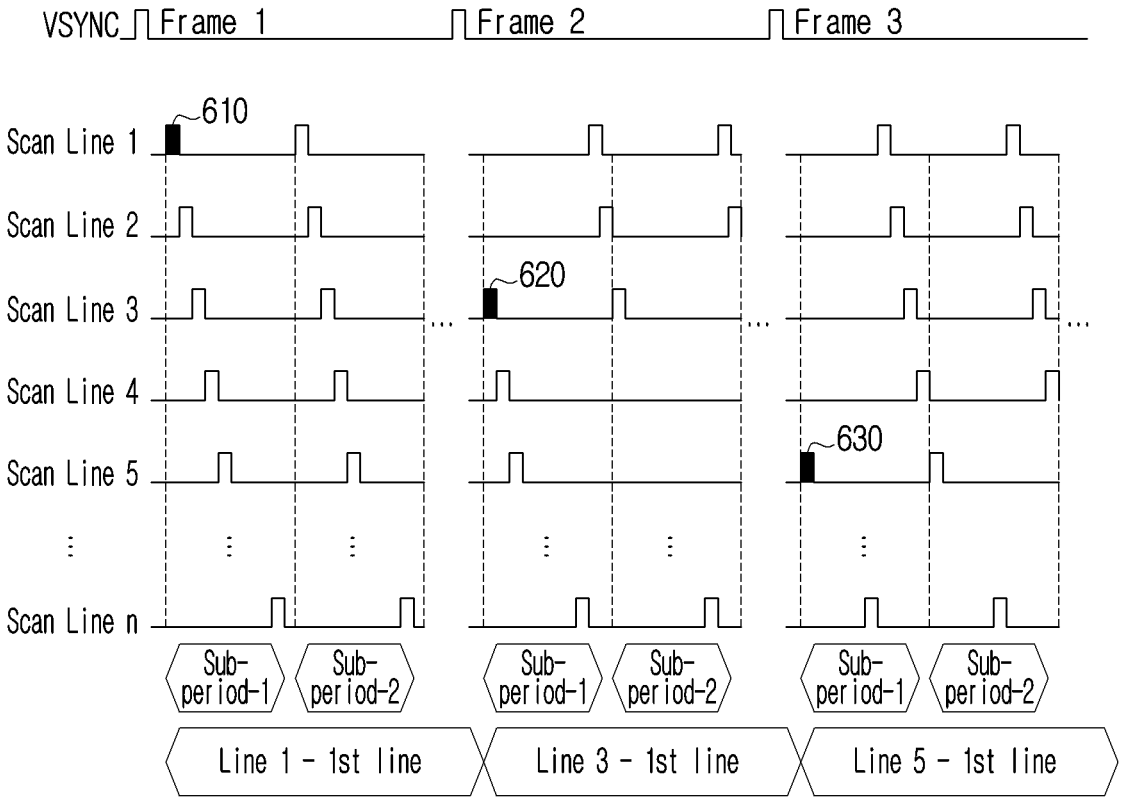
FIG. 6 is a diagram illustrating a second scan line, which is a line after a predetermined line interval from a first scan line according to an embodiment.

FIG. 6 is a diagram illustrating a second scan line, which is a line after a predetermined line interval based on a first scan line according to an embodiment.

According to FIG. 6, the predetermined line interval may be one. That is, a scan line after a first scan line is a second scan line. However, the predetermined line interval may be set differently. For example, when the predetermined line interval is two, then a scan line after the first scan line is a third scan line.

For example, here, the predetermined line interval is set as 2 and the frame interval is set as 1. Based on an image signal 610 corresponding to scan line 1 (first scan line) of frame 1 (first image frame) period being applied for the first time, the controller 130 may apply for the first time an image signal 620 corresponding to scan line 3 (second scan line) of frame 2 (second image frame) period. The controller 130 may then apply for the first time an image signal 630 corresponding to scan line 5 of frame 3 period. That is, as illustrated in FIG. 6, the controller 130 may apply a first image signal sequentially to odd number scan lines (for example, scan line 1, scan line 3, scan line 5 and etc.) in each of the plurality of image frames. However, the above embodiment is not limited thereto, and the first image signal may be applied sequentially to even number scan lines (for example, scan line 2, scan line 4, scan line 6 and etc.) in each of the plurality of images frames.

According to another embodiment, the second scan line may be an arbitrary line different from the first scan line of the plurality of scan lines included in the second image frame.

For example, the controller 130 may apply for the first time the image signal corresponding to scan line 1 (first scan line) in frame 1 (first image frame) period, and may apply for the first time the image signal corresponding to scan line 4 (second scan line) different from scan line 1 in frame 2 (second image frame) period. The controller 130 may then apply for the first time the image signal corresponding to scan line 6 in frame 3 period.

The controller 130 may, based on the image signal corresponding to the third scan line in a previous frame period of the second image frame being finally applied, apply for the first time a signal corresponding to the second scan line adjacent to the third scan line in the second image frame period. The above will be described in greater detail in FIG. 7.

Figure 7:
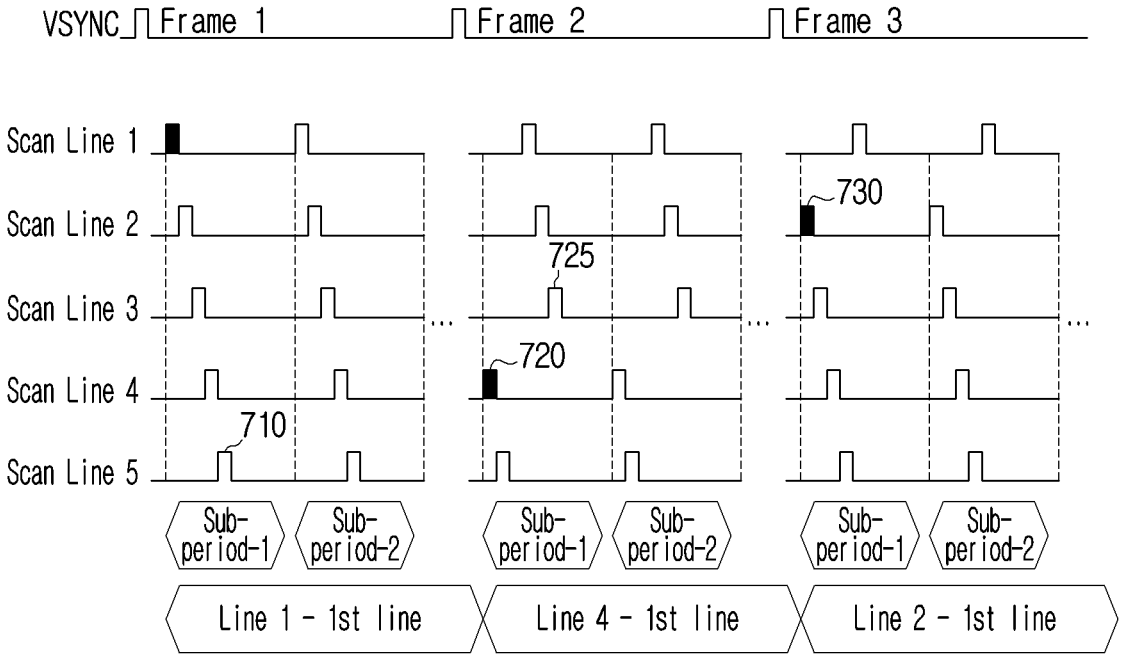
FIG. 7 is a diagram illustrating an operation for determining a second scan line based on a final image signal of each image frame according to an embodiment.

FIG. 7 is a diagram illustrating an operation for determining a second scan line based on a final image signal of each image frame according to an embodiment.

For example, in FIG. 7, a driver 120 being coupled to five scan lines may be assumed.

The scan line applied with an image signal 710 for a final time in frame 1 period which is the previous frame of frame 2 (second image frame) may be scan line 5 (third scan line). In this case, the controller 130 may identify the scan line adjacent to scan line 5 (third scan line) as scan line 4 (second scan line). The controller 130 may apply for the first time an image signal 720 corresponding to scan line 4 (second scan line) in frame 2 (second image frame) period.

In addition, when an image signal 725 is applied to the scan line 3 in frame 2 period as a final image signal, the controller may apply an image signal 730 to scan line 2 adjacent to scan line 3 in frame 3 period as a first image signal in the frame 3 period.

Based on identifying the scan line finally applied with the image signal in the previous frame period and applying for the first time the image signal to the scan line adjacent to the identified scan line in the current frame period, a small current different between image frame may be reduced and the user may not recognize the dim phenomenon.

Although, only the image signal being applied for the first time to the scan line adjacent to the scan line finally applied with the image signal in the previous frame period has been described, the image signal may also identify the finally applied scan line in the previous frame period and apply for the first time an image signal to the identified scan line in the current frame period. For example, in FIG. 7, the scan line with the image signal applied for the first time in frame 2 period may be scan line 5.

The above-described plurality of LED devices may be a micro LED device.

The embodiment for adjusting the scan line being applied for the first time based on an image frame has been described. Furthermore, the scan line applied for the first time may be adjusted based on a sub-period basis. Specifically, the controller 130 may apply for the first time the image signal to the first scan line in the first sub-period of the first image frame period and may apply for the first time the image signal to the second scan line in the second sub-period. In the above-description, the scan line being applied for the first time in a sub-period basis has been described as being sequentially changed, but this is merely one example, and may be changed to various forms based on the first applied scan line in the previous sub-period being different from the first applied scan line in the current sub-period.

The controller 130 has been described as applying for the first time the image signal to scan line 1, which is the scan line corresponding to the LED line arranged at the uppermost end in the display apparatus, in the first image frame, but is not limited thereto.

The controller 130 may be an apparatus implemented as a time controller (TCON) that receives image information and transmits the corresponding image signal to the driver 120, but the controller 130 may be implemented as a controller in the driver 120 that controls an operation or timing of scanning the image signal to each scan line according to another embodiment.

Figure 3:
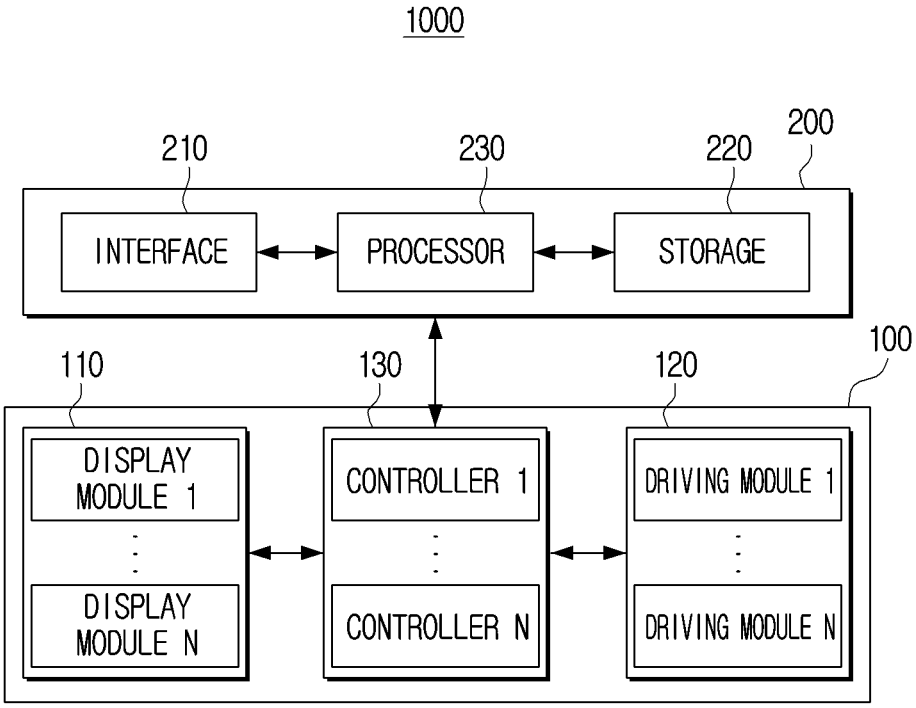
FIG. 3 is a diagram illustrating a configuration of a display system according to an embodiment.

FIG. 3 is a diagram illustrating a configuration of a display system.

The display system 1000 may include a display apparatus 100 and an image processing apparatus 200.

Here, it is assumed that the display apparatus 100 is implemented as a plurality of display modules including a plurality of display modules 110, a driver 120 that drives the plurality of display modules 110, and a plurality of controllers 130. That is, the display apparatus 100 of FIG. 3 may be a modular display apparatus coupled with a plurality of cabinets. A detailed description of parts overlapping with the configurations illustrated in FIG. 2 from the configurations illustrated in FIG. 3 will be omitted.

The controller 130 may, based on the input signal, obtain an image signal corresponding to the display 110. The input signal may be a signal on input image information. For example, based on the display apparatus 100 being implemented as a cabinet coupled with a plurality of LED modules, the input signal may be received from the processor 230 included in an external source box apparatus. Further, based on the display apparatus 100 being implemented as a TV of a signal display module, the input signal may be received from the processor (not shown), that is, a main central processing unit (CPU).

The controller 130 may control the driver 120 to apply a driving voltage or driving current to drive each LED pixel constituting the display 110.

In addition, the image signal may be a signal including a clock signal or a data signal. That is, the controller 130 may obtain the clock signal and the data signal corresponding to each of the plurality of LED modules based on the input signal.

The clock signal may be a signal on time information controlling a timing for displaying an image corresponding to the data signal, and may be output in a square waveform. The data signal may be a signal including data on the image to be displayed in the display apparatus 100. For example, a pixel value, brightness information and the like may be included in the data signal.

The controller 130 may control each of the plurality of LED modules based on the obtained plurality of images signals.

The controller 130 may transmit the clock signal and the data to the driving module of each of the plurality of LED modules. Specifically, the controller 130 may transmit the clock signal to each of the plurality of LED modules through a clock signal transmission wire, and may transmit the data signal to each of the plurality of LED modules through a data transmission wire. That is, the controller 130 may transmit the clock signal and the data signal to the plurality of LED modules through separate wires.

However, the above embodiment is not limited thereto, and methods such as a clock embedding method of transmitting the clock signal and the data signal together in one transmission wire or a method of not requiring a clock signal transmission wire by only encoding and transmitting the data signal and obtaining the clock signal from the encoded data may be applied.

The display apparatus 100 may further include a memory. The memory may store information on the scan line applied for the first time with the image signal in each image frame, time, and the like.

The image processing apparatus 200 may include an interface 210, a storage 220, and a processor 230. The image processing apparatus 200 may be may be implemented as a sending box, a control box, a set top box and the like that processes the input image signal and provides to the display apparatus 100.

The interface 210 may be coupled with the display apparatus 100. Specifically, the interface 210 may be coupled with the display apparatus 100 through a cable coupled to a port. The cable may be a high definition multimedia interface (HDMI) cable. However, this is merely one example, and the cable may be a digital visual interface (DVI) cable, a low voltage differential signals (LVDS) cable, or an optical cable.

In addition, the interface 210 may be connected to the display apparatus 100 through wireless communication. The interface 210 may include a Wi-Fi chip, a Bluetooth chip, a wireless communication chip, or the like.

The storage 220 may store various data required in the operation of the image processing apparatus 200. Specifically, the storage 220 may store image data received from the input apparatus. The input apparatus may be a server, a set top box, a USB storage, a PC, a smartphone, and the like.

The storage 220 may be implemented as a non-volatile memory, a volatile memory, a hard disk drive (HDD) or a solid state drive (SSD), a memory card mounted to the image processing apparatus 200 (for example, a micro SD card, a USB memory, etc.), an external memory capable of connecting to an external input port (for example, USB memory, etc.), and the like.

The processor 230 may control the overall operation of the video image processing apparatus 200.

The processor 230 may include at least one or more of a central processing unit (CPU), a controller, an application processor (AP), a communication processor (CP), or an ARM processor.

In addition, the processor 230 may include a graphic processor (graphic processing unit) for processing graphic corresponding to an image. The processor 230 may be implemented as a System on Chip (SoC) including a core and a GPU. The processor 230 may include a single core, a dual core, a triple core, a quad core, and multiple cores thereof.

The processor 230 according to an embodiment may transmit an input image from the input apparatus to the display apparatus 100 through the interface 210. Specifically, the processor 230 may process the input image to obtain a signal corresponding to each of the plurality of display modules 110 and provide the obtained signal to the controller 130. The controller 130 may then display the image corresponding to the signal on the display screen by controlling the plurality of display modules 110 and the driver 120.

The image processing apparatus 200 has been described as a separate apparatus from the display apparatus 100, but the image processing apparatus 200 may be implemented as one apparatus included in the display apparatus 100. That is, the processor 230 may be included in the display apparatus 100 and implemented as one apparatus.

Figure 8:
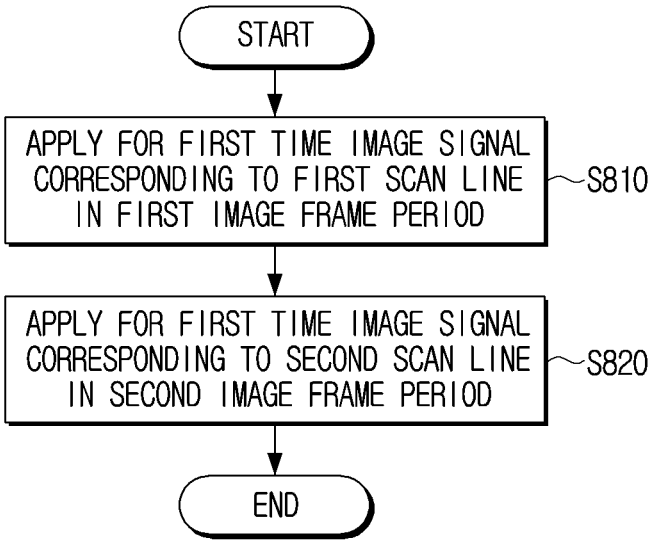
FIG. 8 is a flow chart for describing a control method of a display apparatus according to an embodiment.

FIG. 8 is a flow chart for describing a control method of a display apparatus according to an embodiment.

The display apparatus 100 may be an apparatus that applies the image signal on a scan line basis to the driver driving the plurality of LED devices in the PM method.

The display apparatus 100 may apply for the first time the image signal corresponding to the first scan line in the first image frame period (S810).

Specifically, the display apparatus 100 may apply for the first time the image signal corresponding to the first scan line in the first sub-period of the first image frame period and apply for the first time the image signal corresponding to the first scan line in the second sub-period.

The display apparatus 100 may apply for the first time the image signal corresponding to the second scan line in the second image frame period (S820).

Specifically, the display apparatus 100 may apply for the first time the image signal corresponding to the second scan line in the first sub-period of the second image frame period, and apply for the first time the image signal corresponding to the second scan line in the second sub-period.

The second scan line may be a line immediately following the first scan line. Further, the second scan line may be a line after the predetermined line interval based on the first scan line. Further, the second scan line may be an arbitrary line different from the first scan line among the plurality of scan lines included in the second image frame.

According to another embodiment, the display apparatus 100 may, based on the image signal to the third scan line in the previous frame period of the second image frame being finally applied, apply for the first time a signal to the second scan line adjacent to the third scan line in the second image frame period.

In addition, the second frame may be a frame following the predetermined frame interval based on the frame following the first image frame.

In addition, the display apparatus 100 may apply for the final time the image signal corresponding to the first scan line in each sub-period of the second image frame period. The display apparatus 100 may adjust the predetermined frame interval based on the brightness information of the first image frame.

The plurality of LED devices may be micro LED devices.

The detailed operation of each step has been described above and a detailed description thereof will be omitted.

According to the various embodiments described above, the scan line that first emits light is dispersed to reduce the dim phenomenon of the first scan line, and the display image quality may be improved accordingly.

The methods according to the various embodiments may be implemented in an application form installable in existing electronic apparatuses (display apparatus).

In addition, the methods according to the various embodiments described above may be implemented as a software upgrade or a hardware upgrade on a conventional display apparatus.

In addition, the various embodiments described above may be performed through an embedded server provided on the electronic apparatus or through at least one external server of the electronic apparatus.

According to an embodiment of the disclosure, the various embodiments described above may be implemented with software including instructions stored in the storage medium readable by a machine (e.g., computer). The machine, as an apparatus capable of calling the stored instructions from the storage media and operating according to the called instructions, may include an electronic apparatus according to the disclosed embodiments. Based on instructions being executed by the processor, the processor may directly, or using other elements under the control of the processor may perform functions corresponding to the instructions. The instructions may include a code generated by a compiler or a code executable by an interpreter. The machine-readable storage media may be provided in the form of a non-transitory storage media. Here, the 'non-transitory' storage medium is tangible and does not include a signal, and does not distinguish that data is permanently or temporarily stored in the storage medium.

In addition, according to an embodiment of the disclosure, the method according to various embodiments described above may be provided in a computer program product. A computer program product may be exchanged between a seller and a purchaser as a commodity. A computer program product may be distributed in the form of a machine-readable storage medium (e.g., compact disc read only memory (CD-ROM)) or distributed online through an application store (e.g., PlayStore™). In the case of online distribution, at least a portion of the computer program product may be stored temporarily or at least temporarily in a storage medium such as a manufacturer's server, a server of an application store, or a memory of a relay server.

In addition, according to an embodiment of the disclosure, the various embodiments described herein may be implemented in a computer or a recordable medium capable of reading with a similar apparatus using a software, a hardware, or a combination thereof. In some cases, embodiments described herein may be implemented by the processor itself. According to a software implementation, embodiments such as the procedures and functions described herein may be implemented as separate software modules. Each of the software modules may perform one or more of the functions and operations described herein.

The computer instructions for performing machine processing operations according to the various embodiments described above may be stored in a non-transitory computer-readable medium. The computer instructions stored in this non-transitory computer-readable medium cause a specific device to perform the processing operations of a device according to the various embodiments described above when executed by the processor of a specific device.

The non-transitory computer readable medium may include a compact disc (CD), a digital versatile disc (DVD), a hard disc, a Blu-ray disc, a universal serial bus (USB), a memory card, a read only memory (ROM), and the like.

In addition, each of the elements (e.g., a module or a program) according to the various embodiments described above may be composed of a single entity or a plurality of entities, and some sub-elements of the above-mentioned sub-elements may be omitted or other sub-elements may be further included in various embodiments. Alternatively or additionally, some elements (e.g., modules or programs) may be integrated into one entity to perform the same or similar functions performed by each respective element prior to integration. Operations performed by a module, a program, or other elements, in accordance with various embodiments, may be performed sequentially, in a parallel, repetitive, or heuristically manner, or at least some operations may be performed in a different order, omitted, or may add a different operation.

While the disclosure has been illustrated and described with reference to various embodiments, the disclosure is not limited to the specific embodiments described herein. It will be understood by those skilled in the art that various changes in form and details may be made without departing from the spirit and scope of the disclosure.

What is claimed is:

1. A display apparatus comprising:

a display comprising a plurality of light emitting diode (LED) devices;

a driver configured to drive the plurality of LED devices; and a controller configured to control the driver to apply an image signal to each of a plurality of scan lines, and apply a first image signal to a first image frame period in a first scan line among the plurality of scan lines and apply the first image signal to a second image frame period in a second scan line among the plurality of scan lines;

wherein the second image frame period is a frame period after a predetermined frame period interval from the first image frame period, and wherein the controller is further configured to adjust the predetermined frame interval based on brightness information of a first image frame.

2. The display apparatus of claim 1, wherein the controller is further configured to:

control the driver to apply for a first time the the first image signal to the first scan line in a first sub-period of the first image frame period and apply for a first time the first image signal to the first scan line in a second sub-period of the first image flame period, and control the driver to apply for a first time the first image signal to the second scan line in a first sub-period of the second image frame period and apply for a first time the first image signal to the second scan line in a second sub-period of the second image frame period.

3. The display apparatus of claim 2, wherein the controller is further configured to apply a final image signal among a plurality of image signals to each sub-period of the second image frame period in the first scan line.

4. The display apparatus of claim 1, wherein the second scan line is a scan line immediately below the first scan line.

5. The display apparatus of claim 1, wherein the second scan line is a scan line after a predetermined line interval from the first scan line.

6. The display apparatus of claim 1, where the first scan line comprises a plurality of sections, and wherein a first section among the plurality of sections is included in the first image frame period and a second section among the plurality of sections is included in the second image frame period.

7. The display apparatus of claim 1, wherein the controller is further configured to, based on a third image signal being finally applied to a last one of a plurality of frame periods in a third scan line, apply a fourth image signal to the second image frame period of the second scan line adjacent to the third scan line.

8. The display apparatus of claim 1, wherein each of the plurality of LED devices is a micro LED device.

9. A control method of a display apparatus applying an image signal to a plurality of scan lines, by a driver driving a plurality of light emitting diode (LED) devices in a passive matrix (PM) method, the method comprising:

applying a first image signal to a first image frame period in a first scan line; and applying a second image signal to a second image frame period in a second scan line, wherein the second image frame period is a frame period after a predetermined frame period interval from the first image frame period, and wherein the method further comprises adjusting the predetermined frame interval based on brightness information of a first image frame.

10. The control method of claim 9, wherein the applying for a first time the first image signal to the first scan line further comprises applying for a first time the first image signal to a first sub-period of the first image frame period in the first scan line and applying for a first time the first image signal to a second sub-period of the first image frame period in the first scan line, and wherein the applying for a first time the second image signal to the second scan line further comprises applying for a first time the second image signal to a first sub-period of the second image frame period in the second scan line and applying for a first time the second image signal to a second sub-period of the second image frame period in the second scan line.

11. The control method of claim 10, the method further comprising applying a final image signal among a plurality of image signals to each sub-period of the second image frame period in the first scan line.

12. The Control method of claim 9, wherein the second scan line is a scan line immediately below the first scan line.

13. The control method of claim 9, wherein the second scan line is a scan line after a predetermined line interval from the first scan line.

14. The control method of claim 9, wherein the first scan line includes a plurality of sections, and wherein a first section among the plurality of sections in the first scan line is included in the first image frame period and a second section among the plurality of sections is included in the second image frame period.

15. The control method of claim 9, the method further comprising based on a third image signal being finally applied to a last one of a plurality of frame periods in a third scan line, applying a fourth image signal to the second image frame period of the second scan line adjacent to the third scan line.

16. The control method of claim 9, wherein each of the plurality of LED devices is a micro LED device.

17. A display apparatus comprising:

a display comprising a plurality of light emitting diode (LED) devices;

a driver configured to drive the plurality of LED devices; and a controller configured to control the driver to display an image frame by applying an image signal in a scan line unit, wherein the controller is configured to:

control the driver to apply for a first time an image signal corresponding to a first scan line in a first sub-period of a first image frame period, and sequentially apply an image signal corresponding to each of remaining scan lines excluding the first scan line from among a plurality of scan lines;

apply for a first time an image signal corresponding to the first scan line in a second sub-period of the first image frame period, and sequentially apply an image signal corresponding to each of remaining scan lines excluding the first scan line, apply for a first time an image signal corresponding to a second scan line in a first sub-period of a second image frame period, sequentially apply an image signal corresponding to each of remaining scan lines excluding the second scan line from among the plurality of scan lines, and apply for a last time an image signal corresponding to the first scan line from among the remaining scan lines, and apply for a first time an image signal corresponding to the second scan line in a second sub-period of the second image frame period, sequentially apply an image signal corresponding to each of remaining scan lines excluding the second scan line, and apply for a last time an image signal corresponding to the first scan line from among the remaining lines, wherein the second image frame period is a frame period after a predetermined frame period interval from the first image frame period, and wherein the controller is further configured to adjust the predetermined frame interval based on brightness information of a first image frame.

* * * * *